US008457517B2

(12) United States Patent
Andou

(10) Patent No.: US 8,457,517 B2
(45) Date of Patent: Jun. 4, 2013

(54) IMAGE FORMING APPARATUS AND TRANSFER ROLLER BIAS SYSTEM

(75) Inventor: Yoshihiro Andou, Osaka (JP)

(73) Assignee: Kyocera Document Solutions Inc. (JP)

( * ) Notice: Subject to any disclaimer, the term of this patent is extended or adjusted under 35 U.S.C. 154(b) by 542 days.

(21) Appl. No.: 12/725,213

(22) Filed: Mar. 16, 2010

(65) Prior Publication Data

US 2010/0296832 A1 Nov. 25, 2010

(30) Foreign Application Priority Data

May 20, 2009 (JP) ..... 2009-122108

(51) Int. Cl.
*G03G 15/00* (2006.01)

(52) U.S. Cl.
USPC ..... 399/90; 399/66; 399/121; 399/314; 399/317

(58) Field of Classification Search
USPC ..... 399/66, 90, 121, 297, 310, 314–317
See application file for complete search history.

(56) References Cited

U.S. PATENT DOCUMENTS

| | | | | |
|---|---|---|---|---|
| 4,257,700 | A * | 3/1981 | Tsuda et al. | 399/145 |
| 7,181,152 | B2 * | 2/2007 | Kuma et al. | 399/110 |
| 2007/0196126 | A1 * | 8/2007 | Tanaka et al. | 399/121 |

FOREIGN PATENT DOCUMENTS

| | | |
|---|---|---|
| JP | 2000-293056 | 10/2000 |
| JP | 2005-338733 | 12/2005 |

* cited by examiner

*Primary Examiner* — Walter L Lindsay, Jr.
*Assistant Examiner* — Jessica L Eley
(74) *Attorney, Agent, or Firm* — McDonnell Boehnen Hulbert & Berghoff LLP

(57) ABSTRACT

An image forming apparatus includes a chassis; an image carrier on whose surface a toner image is formed; a transfer roller configured to transfer the toner image formed on the image carrier onto to a recording medium and including a roller shaft and a transfer roller main body; a frame disposed inside the chassis; a transfer-roller supporting part configured to support the transfer roller and to move the transfer roller to a contact position and a spacing position; a terminal member configured to contact an end surface of the roller shaft and supply a voltage; and a terminal supporting member configured to rotatably support the terminal member with respect to the frame, wherein the terminal member rotates while following the movement of the transfer roller between the contact position and the spacing position, and wherein the terminal member maintains a contact state with the end surface of the roller shaft.

12 Claims, 11 Drawing Sheets

IMAGE FORMING APPARATUS AND TRANSFER ROLLER BIAS SYSTEM

INCORPORATION BY REFERENCE

This application is based upon and claims the benefit of priority from the corresponding Japanese Patent application No. 2009-122108, filed May 20, 2009, the entire contents of which are incorporated herein by reference.

BACKGROUND OF THE INVENTION

1. Field of the Invention

The present invention relates to an image forming apparatus such as a multi functional peripheral or a printer.

2. Description of the Related Art

One type of known image forming apparatus is a multi functional peripheral that includes a photosensitive drum with surfaces on which an electrostatic latent image is formed, a developing unit that converts the electrostatic latent image into a toner image, and a transfer roller that directly or indirectly transfers the toner image onto a recording medium. In such a multi functional peripheral, a transfer bias (voltage) is applied to the transfer roller in order to directly or indirectly transfer the toner images formed on the photosensitive drums onto a recording medium. One known image forming apparatus applies a transfer bias to the transfer roller via a spring material by a structure in which the spring material contacts a bearing supporting a roller shaft of the transfer roller from the side of the outer circumferential surfaces of the bearing.

Furthermore, another known color multi functional peripheral uses an intermediate transfer belt and a secondary transfer roller. With such a color multi functional peripheral, a full color image is formed on the surface of the recording medium by transferring a full-color toner image, which is formed by overlapping different color toner images, onto the sheet by using the intermediate transfer belt and the secondary transfer roller.

In such a color multi functional peripheral, the secondary transfer roller is moved by a transfer-roller moving unit between a contact position where the secondary transfer roller contacts the intermediate transfer belt with the sheet interposed therebetween and a spacing position where the secondary transfer roller is spaced apart from the intermediate transfer belt.

When the secondary transfer roller is in the contact position, the secondary transfer roller to which a secondary transfer bias is applied is disposed such that the sheet is sandwiched between the secondary transfer roller and the intermediate transfer belt. Thus, the sheet is pressed against the intermediate transfer belt, and the full-color toner image primarily transferred onto the intermediate transfer belt is secondarily transferred onto the surface of the recording medium.

There is a known color multi functional peripheral that applies a secondary transfer bias via spring material by employing a structure in which the spring material contacts the outer circumferential surface of the rotary shaft of a secondary transfer roller, and the spring material follows the movement of the secondary transfer roller. In such a color multi functional peripheral, even when the secondary transfer roller is moved by the above-mentioned transfer-roller moving unit, since the spring material follows the movement of the secondary transfer roller, a secondary bias can be applied to the secondary transfer roller via the spring material.

With a color multi functional peripheral having such a structure, when the secondary transfer roller is in the contact position, the spring material necessarily follows the movement of the secondary transfer roller and contacts the outer circumferential surface of the rotary shaft in a stable condition. Therefore, the structure of the color multi functional peripheral becomes complicated. Another problem is that the contact state of the spring material and the secondary transfer roller may become unstable due to deterioration of the resilient force of the spring material.

When the peripheral has the above-mentioned transfer-roller moving unit to move the secondary transfer roller, such problems may occur not only in color multi functional peripherals that apply a secondary transfer bias to a secondary transfer roller but also in image forming apparatuses that apply a voltage as a transfer bias to transfer rollers such as a primary transfer roller and a direct transfer roller.

SUMMARY OF THE INVENTION

An object of the present invention is to provide an image forming apparatus that includes a transfer roller and a transfer-roller moving unit for moving the transfer roller and that is capable of stably applying a voltage to the transfer roller and stably forming images.

An image forming apparatus according to the present invention includes a chassis, an image carrier, a transfer roller, a frame disposed within the chassis, a transfer-roller supporting part, a terminal member, and a terminal supporting member. A toner image is formed on a surface of the image carrier. The transfer roller is configured to transfer the toner image formed on the image carrier onto a recording medium, and includes a roller shaft and a transfer roller main body fixed on the roller shaft and configured to contact the recording medium on a circumferential surface thereof. The transfer-roller supporting part is configured to rotatably support the transfer roller with respect to the frame and to move the transfer roller to a contact position where the transfer roller main body contacts the image carrier and a spacing position where the transfer roller main body is spaced apart from the image carrier. The terminal member is configured to contact an end surface of the roller shaft and supply a voltage. The terminal supporting member is configured to rotatably support the terminal member with respect to the frame, wherein the terminal member rotates so as to follow the movement of the transfer roller and maintains a contact state with the end surface of the roller shaft.

DESCRIPTION OF THE PREFERRED EMBODIMENTS

An embodiment of the present invention will be described below with reference to the drawings.

Figure 1:
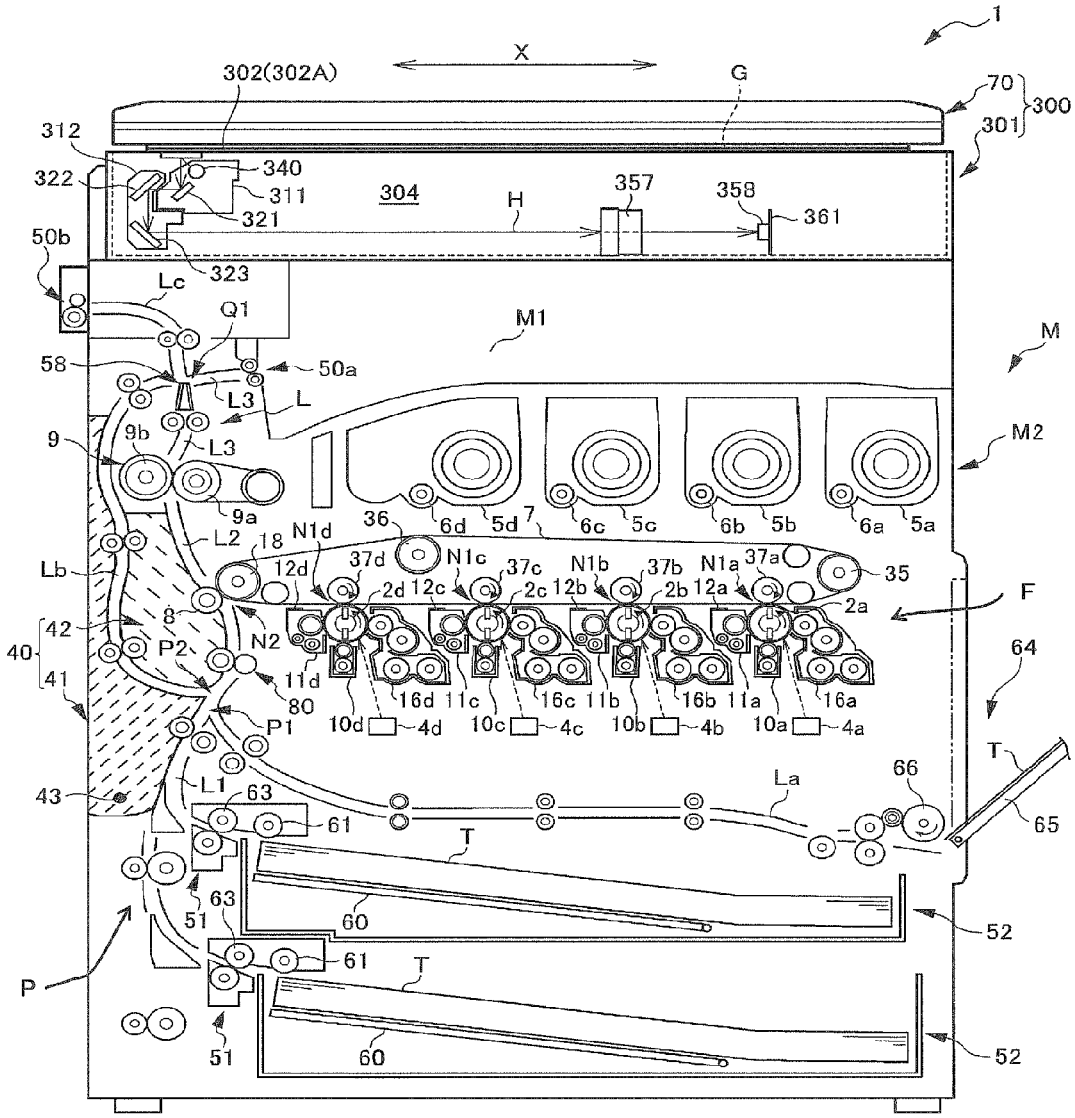
FIG. 1 illustrates the arrangement of components in the multi functional peripheral.

First, the entire configuration of a multi functional peripheral 1 as an image forming apparatus, according to this embodiment will be described with reference to FIG. 1. FIG. 1 illustrates the arrangement of components in the multi functional peripheral 1.

As shown in FIG. 1, the multi functional peripheral 1, as an image forming apparatus, includes an image reading device 300 disposed in the upper section of the multi functional peripheral 1 and a main body M that is disposed in the lower section of the multi functional peripheral 1 and forms a toner image on a sheet T as a recording medium based on image information from the image reading device 300. Hereinafter, although a copying function will be described, the multi functional peripheral 1 has a printer function, fax function and scanning function in addition to the copying function.

As shown in FIG. 1, the image reading device 300 includes a cover member 70 and a reading unit 301 for reading an image of a document G.

The cover member 70 is connected with the reading unit 301 in a manner such that the cover member 70 is opened and closed by a connecting part, which is not shown in the drawings. The cover member 70 protects a reading surface 302A, which is described below.

The reading unit 301 includes the reading surface 302A, an illuminating part 340 having a light source, a plurality of mirrors 321, 322, and 323, first and second frames 311 and 312 that move in a direction parallel to the reading surface 302A, an imaging lens 357, a CCD 358 (which is the reading means), and a CCD substrate 361 that carries out predetermined processing on image data read by the CCD 358 and outputs the image data to the main body M of the apparatus. The illuminating part 340, the plurality of mirrors 321, 322, and 323, first and second frames 311 and 312, imaging lens 357, the CCD 358, and the CCD substrate 361 are disposed in an inner space 304 of the reading unit 301.

The reading surface 302A is formed along the upper surface of a contact glass 302 on which the document G is placed.

The above-mentioned illuminating part 340 and mirror 321 are accommodated in the first frame 311. The mirrors 322 and 323 are accommodated in the second frame 312.

In the inner space 304 of the reading unit 301, the plurality of mirrors 321, 322, and 323 forma light path H for guiding light from the document G into the imaging lens 357. Since the first frame 311 moves in the sub-scanning direction X at a constant speed A and the second frame 312 moves in the sub-scanning direction X at a constant speed A/2, the length of the light path H is maintained constant during image reading. In this way, the image of the document G placed on the reading surface 302A is read.

The main body M includes an image forming unit F that forms a toner image on the sheet T based on image information and a paper feeding/discharging unit P that supplies the sheet T to the image forming unit F and discharges the sheet T on which a toner image is formed.

The external shape of the main body M is formed by a case M2 as a chassis. As shown in FIG. 1, an image forming unit F includes photoreceptor drums 2*a*, 2*b*, 2*c*, and 2*d*, as image carriers (photoreceptors), charging units 10*a*, 10*b*, 10*c*, and 10*d*, laser scanner units 4*a*, 4*b*, 4*c*, and 4*d*, as exposure units, developing units 16*a*, 16*b*, 16*c*, and 16*d*, toner cartridges 5*a*, 5*b*, 5*c*, and 5*d*, toner supplying units 6*a*, 6*b*, 6*c*, and 6*d*, drum cleaning units 11*a*, 11*b*, 11*c*, 11*d*, neutralizers 12*a*, 12*b*, 12*c*, and 12*d*, an intermediate transfer belt 7, primary transfer rollers 37*a*, 37*b*, 37*c*, and 37*d*, a secondary transfer roller 8, as a transfer roller, a counter roller 18, and a fixing unit 9.

As shown in FIG. 1, the paper feeding/discharging unit P includes paper feeding cassettes 52, a manual paper-feeding unit 64, a delivery path L of the sheet T, a resist roller pair 80, a first discharging unit 50*a*, and a second discharging unit 50*b*. As described below, the delivery path L is a collection of a first delivery path L1, a second delivery path L2, a third delivery path L3, a manual paper feeding path La, a return path Lb, and a post-processing path Lc.

The configurations of the image forming unit F and the paper feeding/discharging unit P will be described in detail below.

First, the image forming unit F will be described.

In the image forming unit F, as the photoreceptor drums 2*a*, 2*b*, 2*c*, and 2*d* rotate, the following operations are carried out to the surfaces of the photoreceptor drums 2*a*, 2*b*, 2*c*, and 2*d*, respectively: charging by the charging units 10*a*, 10*b*, 10*c*, and 10*d*, exposure by the laser scanner units 4*a*, 4*b*, 4*c*, and 4*d*, development by the developing units 16*a*, 16*b*, 16*c*, and 16*d*, primary transfer by the intermediate transfer belt 7 (an example of an image carrier) and the primary transfer rollers 37*a*, 37*b*, 37*c*, and 37*d*, neutralization by the neutralizers 12*a*, 12*b*, 12*c*, and 12*d*, and cleaning by the drum cleaning units 11*a*, 11*b*, 11*c*, 11*d*.

Secondary transfer by the intermediate transfer belt 7, the secondary transfer roller 8, and the counter roller 18, and fixing by the fixing unit 9 are carried out in the image forming unit F.

Each of the photoreceptor drums 2*a*, 2*b*, 2*c*, and 2*d* is formed of a cylindrical member and functions as a photoreceptor or an image carrier. Each of the photoreceptor drums 2*a*, 2*b*, 2*c*, and 2*d* is disposed in such a manner that each of the photoreceptor drums 2*a*, 2*b*, 2*c* rotates around a rotary axis extending in a direction orthogonal to the traveling direction of the intermediate transfer belt 7, as shown by the arrow in FIG. 1. An electrostatic latent image is formed on the surface of each photoreceptor drums 2*a*, 2*b*, 2*c*, and 2*d*.

The charging units 10*a*, 10*b*, 10*c*, and 10*d* face the surface of the photoreceptor drums 2*a*, 2*b*, 2*c*, and 2*d*, respectively. The charging units 10*a*, 10*b*, 10*c*, and 10*d* positively charge (positive polarity) the surfaces of the photoreceptor drums 2*a*, 2*b*, 2*c*, and 2*d*, respectively, in a uniform manner.

The laser scanner units 4*a*, 4*b*, 4*c*, and 4*d* function as exposure units and are disposed apart from the surfaces of the photoreceptor drums 2*a*, 2*b*, 2*c*, and 2*d*. Each of the laser scanner units 4*a*, 4*b*, 4*c*, and 4*d* includes a laser light source, a polygon mirror, a motor for driving the polygon mirror, and so on, which are not shown.

The laser scanner units 4*a*, 4*b*, 4*c*, and 4*d* expose the surfaces of the photoreceptor drums 2*a*, 2*b*, 2*c*, and 2*d*, respectively, based on image information related to an image read by the reading unit 301. The electrical charge at sites to be exposed on the surfaces of the photoreceptor drums 2*a*, 2*b*, 2*c*, and 2*d* is removed by being exposed by the laser scanner units 4*a*, 4*b*, 4*c*, and 4*d*, respectively. In this way, an electrostatic latent image is formed on the surface of each photoreceptor drums 2*a*, 2*b*, 2*c*, and 2*d*.

The developing units 16*a*, 16*b*, 16*c*, and 16*d* are disposed corresponding to the photoreceptor drums 2*a*, 2*b*, 2*c*, and 2*d*, respectively, and face the surfaces of the photoreceptor drums 2*a*, 2*b*, 2*c*, and 2*d*, respectively. The developing units 16*a*, 16*b*, 16*c*, and 16*d* attach color toners to the sites where the electrical charge is removed formed on the photoreceptor drums 2*a*, 2*b*, 2*c*, and 2*d* (i.e., toner images are formed on the surface of the photoreceptor drums). The developing units 16*a*, 16*b*, 16*c*, and 16*d* correspond to four toner colors, yellow, cyan, magenta, and black, respectively. Each of the developing units 16*a*, 16*b*, 16*c*, and 16*d* includes a developing roller that faces the surface of the photoreceptor drums 2*a*, 2*b*, 2*c*, and 2*d* respectively, a stirring roller for stirring the toner, and so on, which are not shown.

The toner cartridges 5*a*, 5*b*, 5*c*, and 5*d* are disposed corresponding to the developing units 16*a*, 16*b*, 16*c*, and 16*d*, respectively, and accommodate different color toners for supplying to the developing units 16*a*, 16*b*, 16*c*, and 16*d*, respectively. The toner cartridges 5*a*, 5*b*, 5*c*, and 5*d* accommodate yellow toner, cyan toner, magenta toner, and black toner, respectively.

The toner supplying parts 6*a*, 6*b*, 6*c*, and 6*d* are disposed corresponding to the toner cartridges 5*a*, 5*b*, 5*c*, and 5*d*, respectively, and the developing units 16*a*, 16*b*, 16*c*, and 16*d*, respectively, and the different color toners accommodated in the toner cartridges 5*a*, 5*b*, 5*c*, and 5*d* are supplied to the developing units 16*a*, 16*b*, 16*c*, and 16*d*, respectively. The toner supplying parts 6*a*, 6*b*, 6*c*, and 6*d* are connected with toner supplying members (not shown) to the developing units 16*a*, 16*b*, 16*c*, and 16*d*, respectively.

Toner images of different colors formed on the photoreceptor drums 2*a*, 2*b*, 2*c*, and 2*d* are transferred onto the intermediate transfer belt 7 in sequence. The intermediate transfer belt 7 is wound around a driven roller 35, the counter roller 18 as a driving roller, a tension roller 36, and so on. Since the tension roller 36 urges the intermediate transfer belt 7 from the inner side toward the outer side, a suitable tension is applied to the intermediate transfer belt 7.

On the other side of the intermediate transfer belt 7 from the photoreceptor drums 2*a*, 2*b*, 2*c*, and 2*d*, the primary transfer rollers 37*a*, 37*b*, 37*c*, and 37*d* are disposed in such a manner that the primary transfer rollers 37*a*, 37*b*, 37*c* face the intermediate transfer belt 7.

The intermediate transfer belt 7 is interposed between the primary transfer rollers 37*a*, 37*b*, 37*c*, and 37*d* and the photoreceptor drums 2*a*, 2*b*, 2*c*, and 2*d*. The interposed section of the intermediate transfer belt 7 is pushed against the surfaces of the photoreceptor drums 2*a*, 2*b*, 2*c*, and 2*d*. Primary transfer nips N1*a*, N1*b*, N1*c*, and N1*d* are formed between the photoreceptor drums 2*a*, 2*b*, 2*c*, and 2*d*, respectively, and the primary transfer rollers 37*a*, 37*b*, 37*c*, and 37*d*, respectively. The different color toner images formed on the photoreceptor drums 2*a*, 2*b*, 2*c*, and 2*d* are transfer onto the intermediate transfer belt 7 at the primary transfer nips N1*a*, N1*b*, N1*c*, and N1*d*, respectively in sequence. In this way, a full-color toner image is formed on the intermediate transfer belt 7.

A voltage applying means (not shown) applies a primary transfer bias to the primary transfer rollers 37*a*, 37*b*, 37*c*, and 37*d*, in order to transfer the different color toner images formed on the photoreceptor drums 2*a*, 2*b*, 2*c*, and 2*d* to the intermediate transfer belt 7.

The neutralizers 12*a*, 12*b*, 12*c*, and 12*d* are disposed facing the surfaces of the photoreceptor drums 2*a*, 2*b*, 2*c*, and 2*d*, respectively. The neutralizers 12*a*, 12*b*, 12*c*, and 12*d* neutralize (remove the electrical charge from) the surfaces of the photoreceptor drums 2*a*, 2*b*, 2*c*, and 2*d*, respectively, after primary transfer by irradiating the surfaces of the photoreceptor drums 2*a*, 2*b*, 2*c*, and 2*d*, respectively, with light.

The drum cleaning units 11*a*, 11*b*, 11*c*, and 11*d* are disposed facing the surfaces of the photoreceptor drums 2*a*, 2*b*, 2*c*, and 2*d*, respectively. The drum cleaning units 11*a*, 11*b*, 11*c*, 11*d* remove remaining toner and extraneous matter from the surfaces of the photoreceptor drums 2*a*, 2*b*, 2*c*, and 2*d*, respectively, after primary transfer and deliver the removed toner to a collecting mechanism (not shown) for collection.

The secondary transfer roller 8 carries out secondary transfer of the primarily transferred toner image that has been transferred onto the intermediate transfer belt 7 onto the sheet T. A voltage applying unit 400 (see FIG. 2), as a voltage applying means described below, applies a secondary transfer bias to the secondary transfer roller 8 in order to transfer the toner image formed on the intermediate transfer belt 7 to the sheet T.

The secondary transfer roller 8 (i.e., main body 8*a* thereof, described below) is in contact with or spaced apart from the intermediate transfer belt 7 by a transfer-roller moving unit 250 described below (see FIG. 2). The transfer-roller moving unit 250 moves the secondary transfer roller 8 between a contact position (see FIG. 9) where the secondary transfer roller 8 contacts the intermediate transfer belt 7 with the sheet T interposed therebetween and a spacing position (see FIG. 8) where the secondary transfer roller 8 is spaced apart from the intermediate transfer belt 7. More specifically, the secondary transfer roller 8 is moved by the transfer-roller moving unit 250 in such a manner that the secondary transfer roller 8 moves between the contact position where the secondary transfer roller 8 is in contact with the intermediate transfer belt 7 and the spacing position where the secondary transfer roller 8 is spaced apart from the intermediate transfer belt 7. Even more specifically, the secondary transfer roller 8 moves to the contact position when the toner image transferred to the surface of the intermediate transfer belt 7 by primary transfer is transferred onto the sheet T by secondary transfer and moves to the spacing position in any other case. Details of the secondary transfer roller 8 and the transfer-roller moving unit 250 will be described below.

The counter roller 18 is disposed on a side of the intermediate transfer belt 7 opposite to the side on which the secondary transfer roller 8 is disposed. A secondary transfer nip N2 is formed between the secondary transfer roller 8 and the intermediate transfer belt 7. At the secondary transfer nip N2, the toner image primarily transferred onto the intermediate transfer belt 7 is secondarily transferred to the sheet T.

The fixing unit 9 melts the different color toners forming the secondarily-transferred toner image on the sheet T to fix the image on the sheet T. The fixing unit 9 includes a heating roller 9*a* that is heated by a heater and a pressing roller 9*b* that is push-contacted with the heating roller 9*a*. The heating roller 9*a* and the pressing roller 9*b* sandwich and convey the sheet T on which the toner image is secondarily transferred. By conveying the sheet T while being sandwiched between the heating roller 9*a* and the pressing roller 9*b*, the transferred toner on the sheet T melts and is fixed to the sheet T.

Next, the paper feeding/discharging unit will be described.

As shown in FIG. 1, two paper supplying cassettes 52 that accommodate the sheets T are disposed one above the other in the lower section of the main body M. The paper supplying cassettes 52 can be pulled out in the horizontal direction from a case M2 of the main body M. In each of the paper supplying cassettes 52, a platen 60 where the sheets T are placed is disposed. The sheets T are stacked on the platens 60 in the paper supplying cassettes 52. The sheet T placed on the platen 60 is sent out to the delivery path L by a cassette paper-feeding unit 51 disposed at the sheet feeding end (left end in FIG. 1) of the paper supplying cassette 52. The cassette paper-feeding unit 51 includes a forward-feeding roller 61 that takes out a sheet T from the platen 60 and a multi-feed prevention mechanism that includes a feeding roller pair 63 for sending the single sheet T (or multiple single sheets T, one by one) to the delivery path L.

A manual feeding unit 64 is provided on the right side surface (right side in FIG. 1) of the main body M. The main purpose of providing the manual feeding unit 64 is to supply to the main body M sheets T having different sizes and types compared to the sheets T set in the paper supplying cassettes 52. The manual feeding unit 64 includes a manual-feeding tray 65 that configures part of the main body M when the manual-feeding tray is in a closed position and a paper-feeding roller 66. The lower edge of the manual-feeding tray 65 is attached to the main body M near the paper-feeding roller 66 in such a manner that the manual-feeding tray 65 freely rotates (opens and closes). The sheets T are placed on the opened manual-feeding tray 65. The paper-feeding roller 66 feeds the sheets T placed on the opened manual-feeding tray 65 to the manual paper feeding path La.

The first discharging unit 50*a* and the second discharging unit 50*b* are provided in the upper section of the main body M. The first discharging unit 50*a* and the second discharging unit 50*b* discharge the sheets T outside the main body M. Details of the first discharging unit 50*a* and the second discharging unit 50*b* will be described below.

The delivery path L through which the sheets T are delivered includes the first delivery path L1 from the cassette paper-feeding unit 51 to the secondary transfer nip N2, the second delivery path L2 from the secondary transfer nip N2 to the fixing unit 9, the third delivery path L3 from the fixing unit 9 to the first discharging unit 50*a*, the manual paper feeding path La that sends the sheets from the manual feeding unit 64 to the first delivery path L1, the return path Lb that reverses the sheets delivered from upstream to downstream of the third delivery path L3 and returns them to the first delivery path L1, and the post-processing path Lc that delivers the sheets delivered from upstream to downstream of the third delivery path L3 to a post-processing device (not shown).

A first merging section P1 and a second merging section P2 are provided midway through the first delivery path L1. A first branching section Q1 is provided midway through the third delivery path L3.

At the first merging section P1, the manual paper feeding path La merges with the first delivery path L1. At the second merging section P2, the return path Lb merges with the first delivery path L1.

At the first branching section Q1, the post-processing path Lc branches off the third delivery path L3. A rectifying member 58 is provided at the first branching section Q1. The rectifying member 58 rectifies (switches) delivery direction of the sheets T delivered from the fixing unit 9 to the third delivery path L3 connected to the first discharging unit 50*a* or the post-processing path Lc connected to the second discharging unit 50*b*.

A sensor (not shown) that detects the sheets T and the resist roller pair 80 that corrects skew (oblique feeding) of the sheets T and matches the timing of the toner image formation are provided midway through the first delivery path L1 (more specifically, between the second merging section P2 and the secondary transfer nip N2). The sensor is disposed immediately before (upstream of) the resist roller pair 80 in the delivery direction of the sheets T. The resist roller pair 80 delivers the sheets T after carrying out the above-mentioned correction and timing control based on detection signal information from the sensor.

The return path Lb is provided so that when double-sided printing is carried out on the sheet T, the surface opposite of the surface already printed (no-print surface) faces the intermediate transfer belt 7. The return path Lb delivers the sheet T upstream of the resist roller pair 80 disposed upstream of the secondary transfer roller 8 by reversing the sheet T delivered from the first branching section Q1 to the first discharging unit 50*a* and returning the sheet T to the first delivery path L1. A toner image is transferred from the intermediate transfer belt 7 onto the no-print surface of the sheet T, which has been reversed by the return path Lb.

The first discharging unit 50*a* is formed at the end of the third delivery path L3 and is disposed in the upper section of the main body M. The first discharging unit 50*a* has an opening in the right side surface (right side in FIG. 1, i.e., the manual feeding unit 64 side) of the main body M. The first discharging unit 50*a* discharges the sheets T delivered through the third delivery path L3 outside the main body M.

A discharged-paper accumulator M1 is formed on the opening side of the first discharging unit 50*a*, on the upper surface (outer surface) of the main body M. The discharged-paper accumulator M1 is a depression in the upper surface of the main body M. The bottom surface of the discharged-paper accumulator M1 forms a part of the upper surface of the main body M. The sheets T discharged from the first discharging unit 50*a* after toner images are fixed thereon are accumulated in the discharged-paper accumulator M1 in the staking state.

The second discharging unit 50*b* is formed on the end section of the post-processing path Lc and is disposed in the upper section of the main body M. The second discharging unit 50*b* has an opening in the left side surface (left side in FIG. 1, i.e., the side to which a post-processing device is connected) of the main body M. The second discharging unit 50*b* discharges the sheets T delivered through the post-processing path Lc outside the main body M.

A post-processing device (not shown) is connected to the opening side of the second discharging unit 50*b*. The post-processing device carries out post-processing (stapling, punching, etc .) on the sheets discharged from the image forming apparatus (multi functional peripheral 1).

Sensors (not shown) that detect the sheets are disposed at predetermined positions in each of the delivery paths.

The configuration for removing jamming in the main delivery paths L1 to L3 (hereinafter the first delivery path L1, the second delivery path L2, and the third delivery path L3, collectively referred to as a "main delivery path") and the return path Lb will be briefly described.

As shown in FIG. 1, the main delivery path L1 to L3 and the return path Lb are aligned mainly in the vertical direction on the left side surface side (left side in FIG. 1) of the main body M. A cover body 40 that forms a part of the side surface of the main body M is provided on the left side surface side (left side in FIG. 1) of the main body M. The cover body 40 is connected at its lower edge to the main body M via a fulcrum shaft 43. The fulcrum shaft 43 is arranged in such a manner that its shaft direction intersects with the main delivery path L1 to L3 and the return path Lb. The cover body 40 pivots around the fulcrum shaft 43 between a closed position (position shown in FIG. 1) and an open position (not shown).

The cover body 40 includes a first cover part 41 that is attached to the main body M by the fulcrum shaft 43 in such a manner that the first cover part 41 can be pivoted and a second cover part 42 that is attached to the main body M by the same fulcrum shaft 43 in such a manner that the second cover part 42 can be pivoted. The first cover part 41 is positioned further outward (closer to the side surface) than the second cover part 42 in the main body M. In FIG. 1, the first cover part 41 is represented by the area hatched with dotted lines running downwards toward the left and the second cover part 42 is represented by the area hatched with dotted lines running downwards toward the right.

With the cover body 40 in a closed state, the outer surface of the first cover part 41 forms a part of the outer surface (side surface) of the main body M.

With the cover body 40 in a closed state, the inner side surface (main body M side) of the second cover part 42 forms a part of the main delivery paths L1 to L3.

With the cover body 40 in a closed state, the inner surface of the first cover part 41 and the outer surface of the second cover part 42 form at least a part of the return path Lb. In other words, the return path Lb is formed between the first cover part 41 and the second cover part 42.

The above-described cover body 40 provides for removing jammed sheets. For example, when jamming occurs in the main delivery path L1 to L3, the sheet jammed in the main delivery path L1 to L3 can be removed by opening the main delivery path L1 to L3 by turning the cover body 40 from the closed position shown in FIG. 1 to the opened position (not shown). When jamming occurs in the return path Lb, after turning the cover body 40 to the opened position, by turning the second cover part 42 around the fulcrum shaft 43 to the main body M side (right side in FIG. 1) to open the return path Lb, the sheet jammed in the return path Lb can be removed.

Next, an embodiment of the present invention will be described with focus on the structure related to the secondary transfer roller 8, the transfer-roller moving unit 250, and the voltage applying unit 400, with reference to FIGS. 2 to 11.

Figure 2:
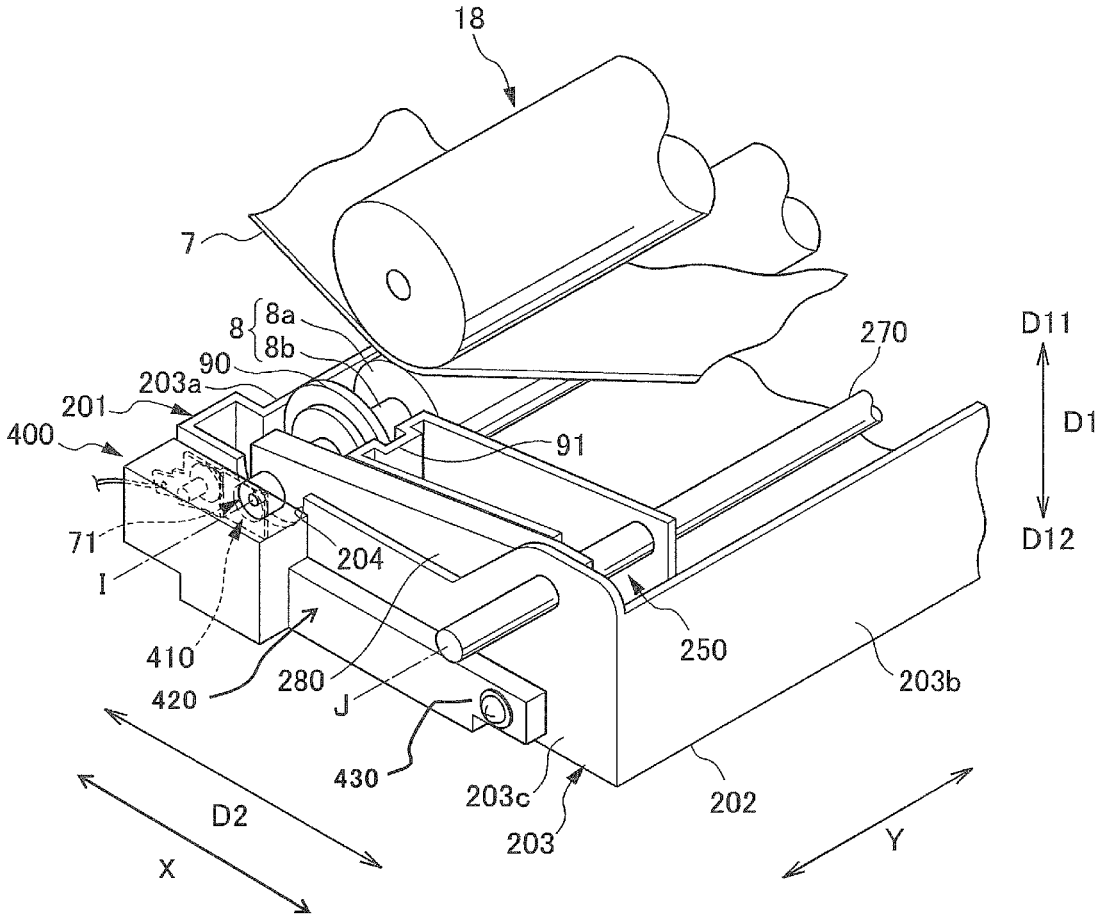
FIG. 2 is a perspective view illustrating a state in which a terminal member of a voltage applying unit of an embodiment of the present invention contacts a secondary transfer roller.
Figure 3:
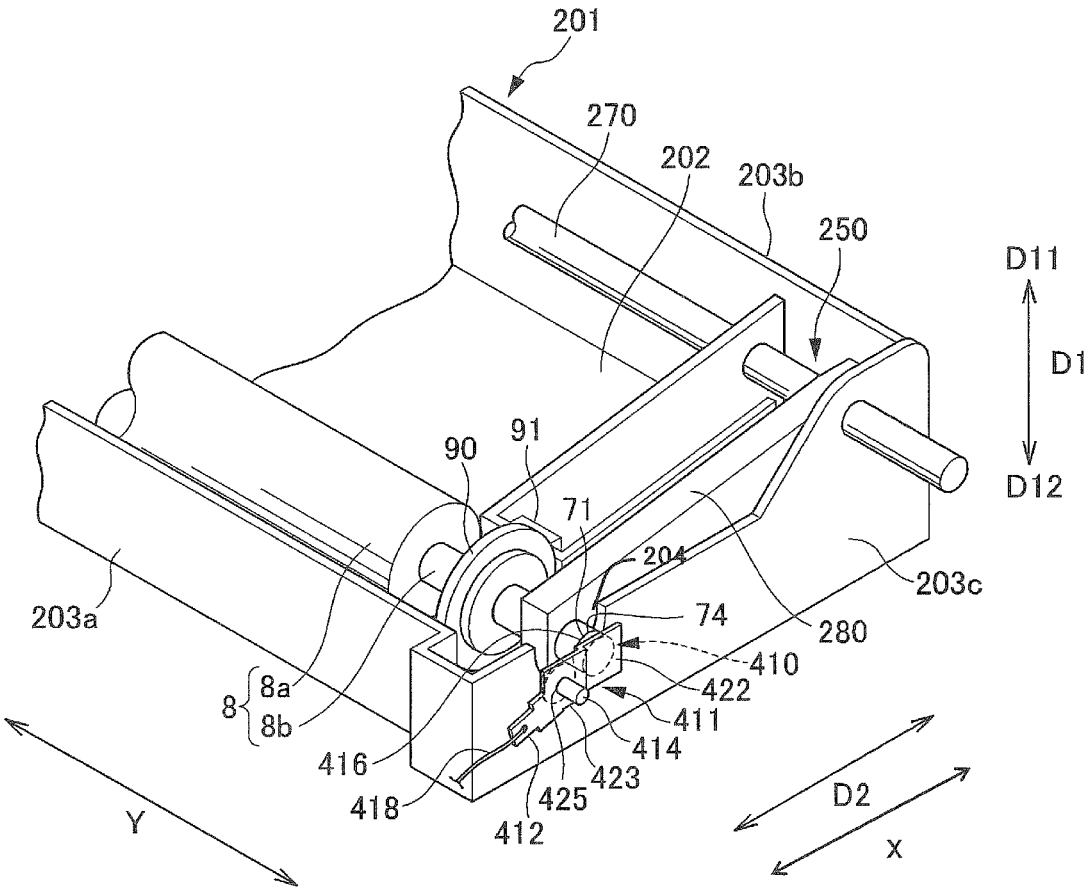
FIG. 3 is a perspective view from an angle different from that of FIG. 2, illustrating a state in which a cover member is removed from the state illustrated in FIG. 2.
Figure 4:
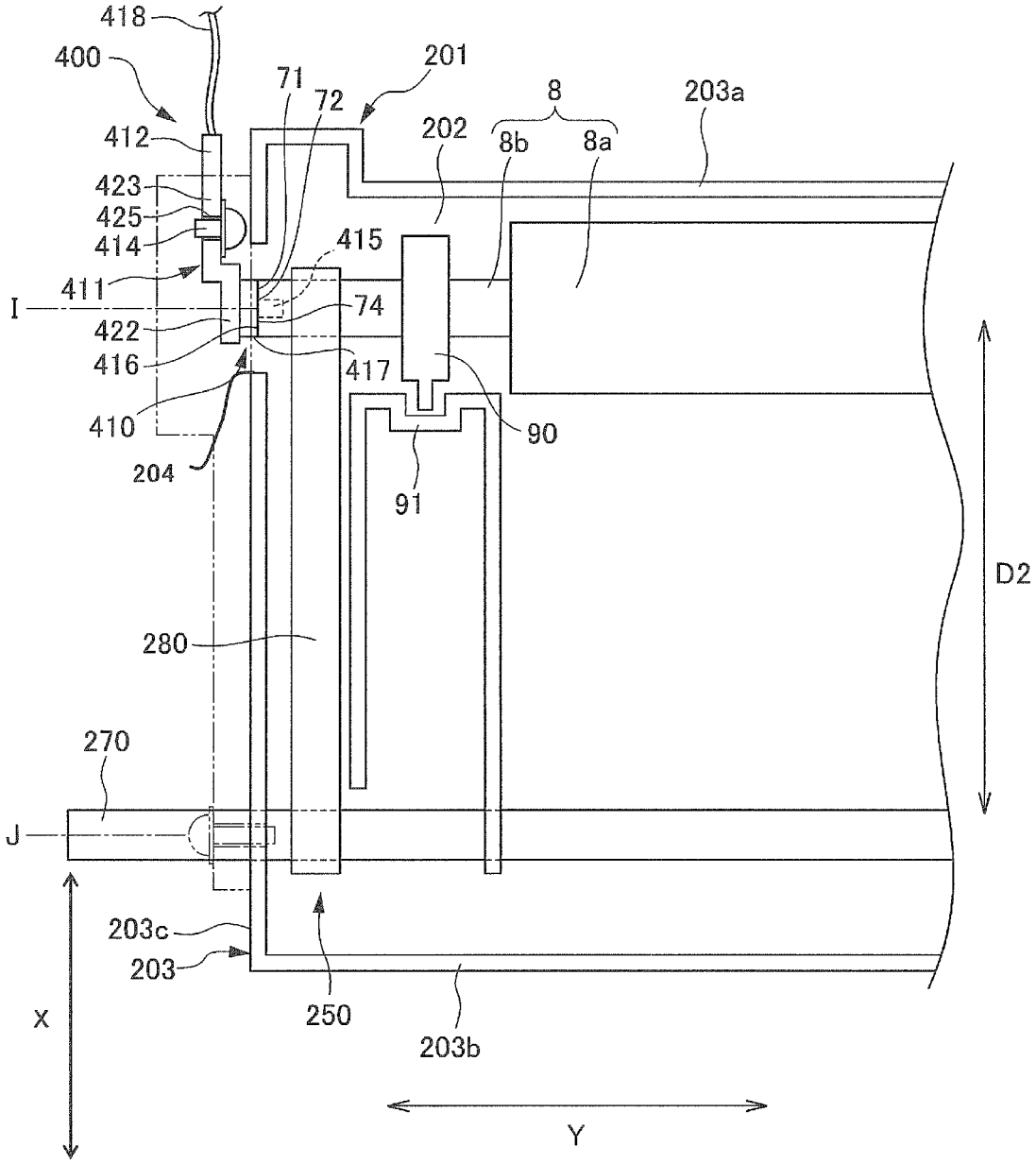
FIG. 4 is a plan view of the state illustrated in FIG. 2.
Figure 5:
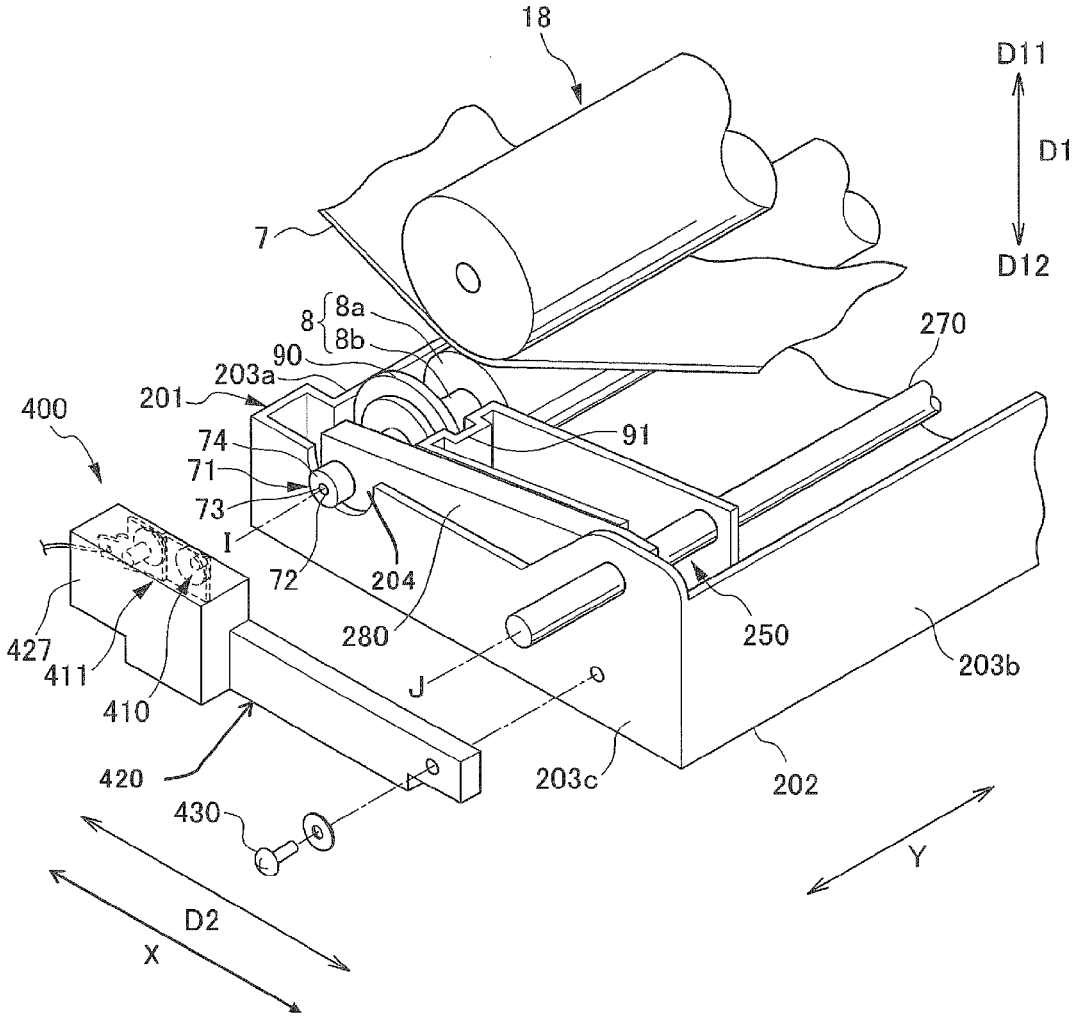
FIG. 5 is a perspective view illustrating a state in which the voltage applying unit including the terminal member is removed from the state illustrated in FIG. 2.
Figure 6:
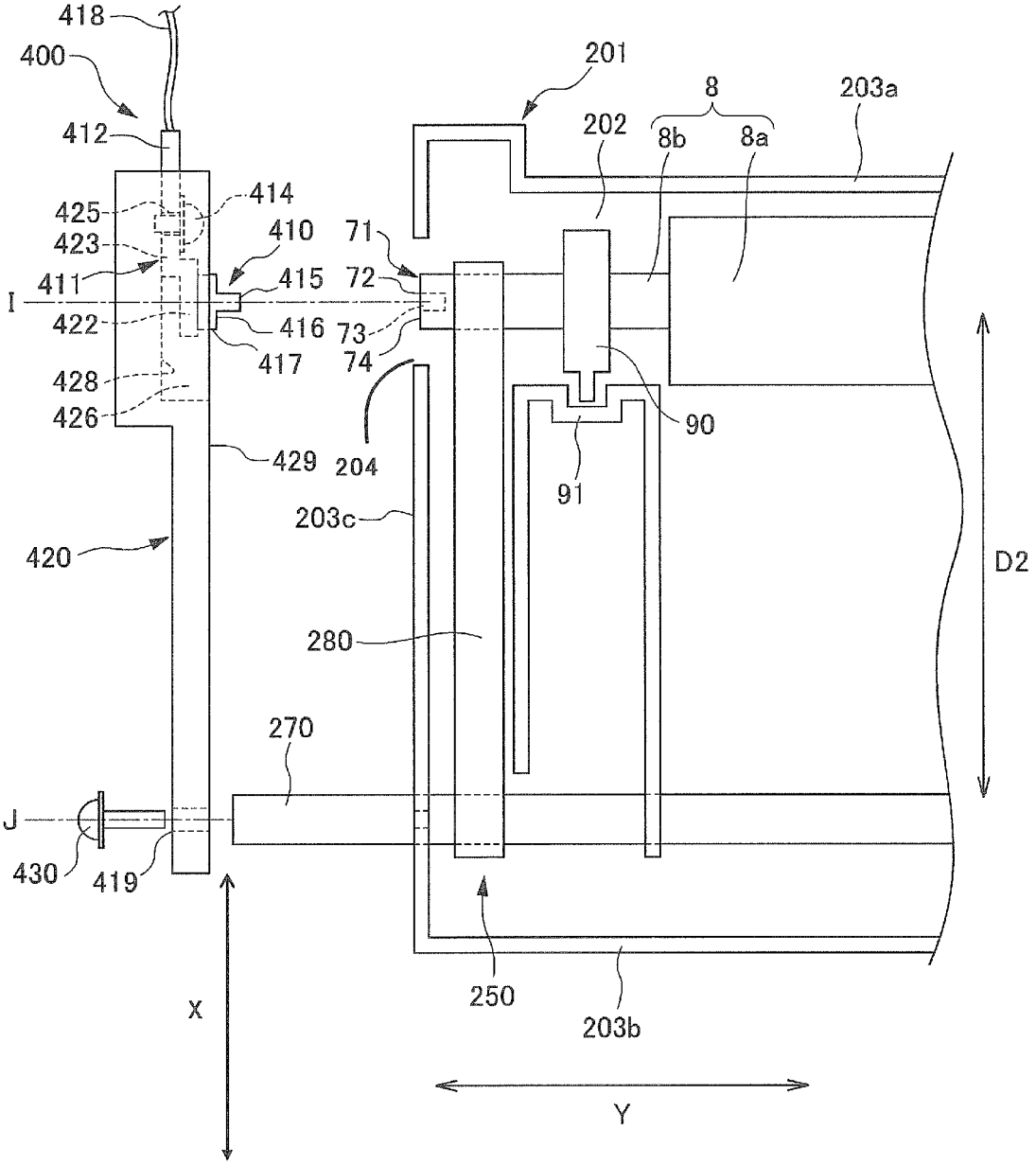
FIG. 6 is a plan view of the state illustrated in FIG. 5.
Figure 7:
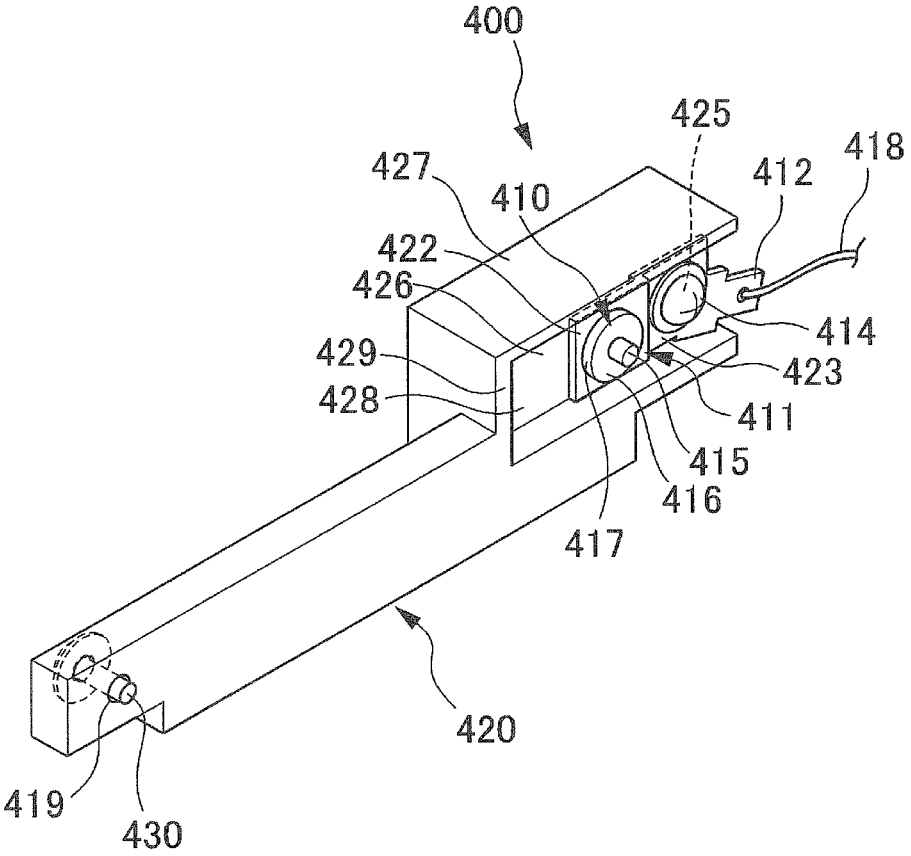
FIG. 7 is a perspective view illustrating a voltage applying unit according to an embodiment of the present invention.
Figure 8:
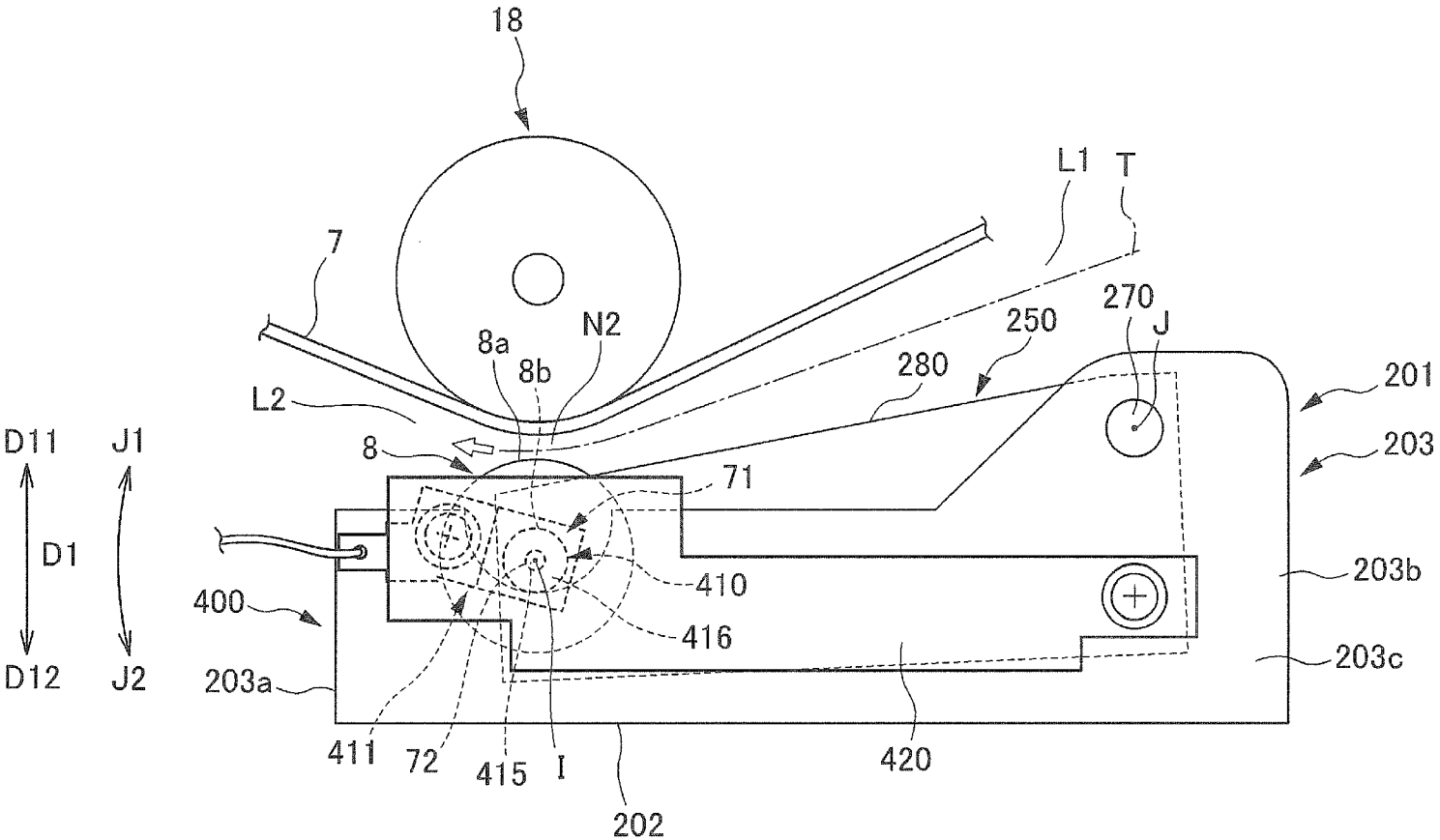
FIG. 8 illustrates a state in which a secondary transfer roller according to an embodiment of the present invention is in a spacing position spaced apart from the intermediate transfer belt.
Figure 9:
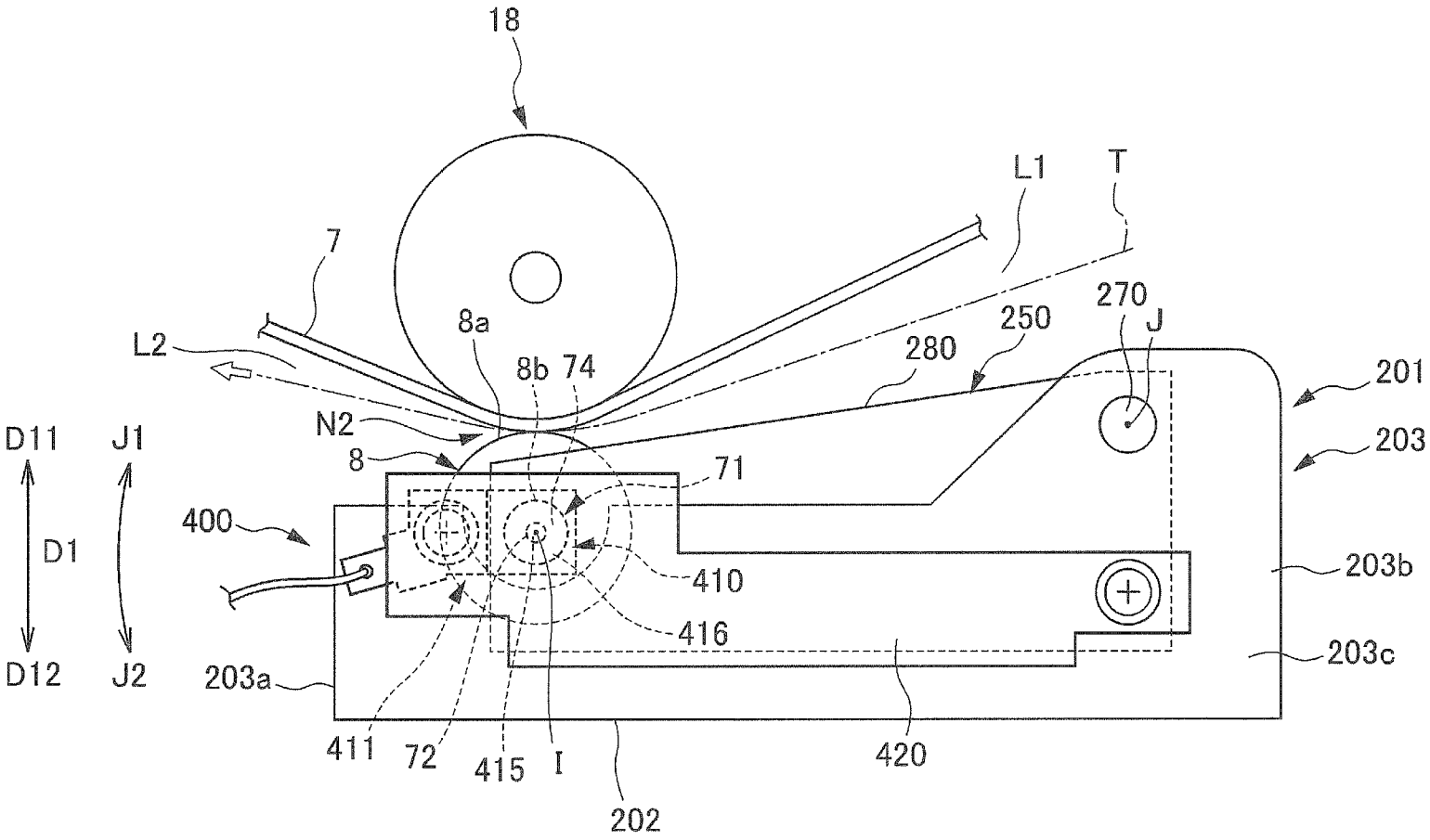
FIG. 9 illustrates a state in which a secondary transfer roller according to an embodiment of the present invention contacts an intermediate transfer belt, thereby forming a secondary transfer nip, and conveys a sheet T in a contact position.
Figure 10:
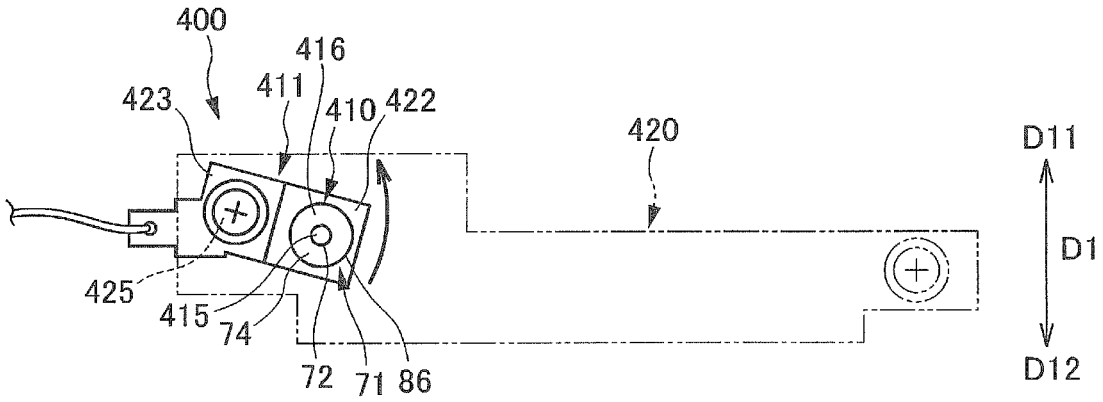
FIG. 10 illustrates the position of the terminal member in the state illustrated in FIG. 8.
Figure 11:
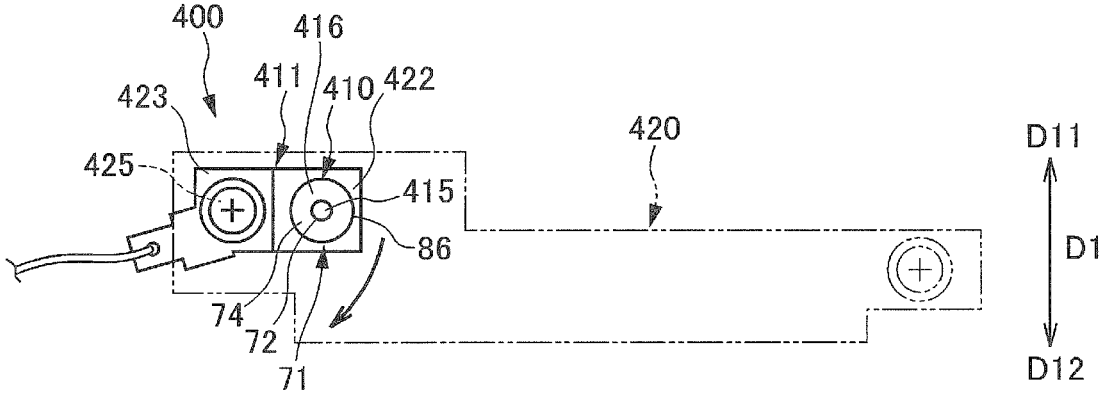
FIG. 11 illustrates the position of the terminal member in the state illustrated in FIG. 9.

FIG. 2 is a perspective view illustrating a state in which a terminal member 410 of the voltage applying unit 400 of an embodiment of the present invention contacts the secondary transfer roller 8. FIG. 3 is a perspective view from an angle different from that of FIG. 2, illustrating a state in which a cover member 420 is removed from the state illustrated in FIG. 2. FIG. 4 is a plan view of the state illustrated in FIG. 2. FIG. 5 is a perspective view illustrating a state in which the voltage applying unit 400 including the terminal member 410 is removed from the state illustrated in FIG. 2. FIG. 6 is a plan view of the state illustrated in FIG. 5. FIG. 7 is a perspective view illustrating a voltage applying unit 400 according to an embodiment of the present invention. FIG. 8 illustrates a state in which a secondary transfer roller 8 according to an embodiment of the present invention is in a spacing position spaced apart from the intermediate transfer belt 7. FIG. 9 illustrates a state in which a secondary transfer roller 8 according to an embodiment of the present invention contacts with an intermediate transfer belt 7 (thereby forming a secondary transfer nip) to convey a sheet T that is in a contact position for delivery. FIG. 10 illustrates the position of the terminal member 410 in the state illustrated in FIG. 8. FIG. 11 illustrates the position of the terminal member 410 in the state illustrated in FIG. 9.

As shown in FIGS. 2 to 4, the multi functional peripheral 1 according to this embodiment includes the secondary transfer roller 8, a frame 201 that accommodates the secondary transfer roller 8, the transfer-roller moving unit 250 that moves the secondary transfer roller 8, the counter roller 18, the intermediate transfer belt 7, and the voltage applying unit 400 that applies a secondary transfer bias to the secondary transfer roller 8.

The secondary transfer roller 8 includes a roller shaft 8*b* that is supported in a rotatable manner and a transfer roller main body 8*a* that is fixed on the roller shaft 8*b* and contacts the sheet T on the circumferential surface thereof(see FIGS. 8 and 9). The transfer roller main body 8*a* and the roller shaft 8*b* extend for a long distance in the direction of the rotary axis I of the secondary transfer roller 8. The transfer roller main body 8*a* is formed of a cylindrical conductive member. The roller shaft 8*b* is formed of a columnar conductive material.

The secondary transfer roller 8 is accommodated in the frame 201. The frame 201 includes a base 202 formed below and a wall 203 that is disposed on the outer edge of the bottom surface 202 and formed in a first direction D1 orthogonal to the bottom surface 202. The wall 203 includes a first wall section 203*a* and a second wall section 203*b* that form a peripheral wall of the frame 201, extend in the main scanning direction Y, and face each other, as well as a third wall section 203*c* and a fourth wall section (not shown) that form a peripheral wall of the frame 201, extend in the sub-scanning direction X and face each other.

The secondary transfer roller 8 is supported parallel to the main scanning direction Y and between the third wall section 203*c* and the fourth wall section close to the first wall section 203*a* inside the frame 201. The respective ends of the roller shaft 8*b* are supported in a rotatable manner at predetermined positions on the third wall section 203*c* and the fourth wall section.

A depression 204 in the vertical direction is formed in the third wall section 203*c* where one of the ends of the roller shaft 8*b* is positioned. One of the ends of the roller shaft 8*b* is disposed in the depression 204. The depression 204 is depressed such that the roller shaft 8*b* moved in the first direction D1 by the transfer-roller moving unit 250 does not contact the third wall section 203*c*. The direction in which the secondary transfer roller 8 moves from the spacing position (see FIG. 8) where the transfer roller main body 8*a* of the secondary transfer roller 8 is spaced apart from the intermediate transfer belt 7 to the contact position (see FIG. 9) where the transfer roller main body 8*a* of the secondary transfer roller 8 contacts the intermediate transfer belt 7 with the sheet T interposed therebetween is referred to as a first contact direction D11. Conversely, the direction in which the secondary transfer roller 8 moves from the contact position where the transfer roller main body 8*a* of the secondary transfer roller 8 contacts the intermediate transfer belt 7 with the sheet T interposed therebetween to the spacing position (see FIG. 9) where the transfer roller main body 8*a* of the secondary transfer roller 8 is spaced apart from the intermediate transfer belt 7 is referred to as a first spacing direction D12.

The multi functional peripheral 1 includes a restricting structure that restricts the roller shaft 8*b* moving in the first direction D1 from moving to the main scanning direction Y. The restricting structure includes a disk-shaped restricting part 90 that is fixed on the roller shaft 8*b* and a restricting groove 91 that extends from the base 202 of the frame 201 in the vertical direction (the first direction) D1. The disk-shaped restricting part 90 is interposed between one end surface the transfer roller main body 8*a* in the rotary axis I direction (main scanning direction Y) and one end surface 71 of the roller shaft 8*b*. The restricting groove 91 is shaped as a groove in such a manner that the moving disk-shaped restricting part 90 in the rotary axis I direction (main scanning direction Y) is sandwiched.

As shown in FIGS. 5 and 6, a hole 73 drilled in the rotary axis I direction and a first contact section (contact surface) 74 disposed circumferentially outside the hole 73 are formed on the end surface 71 in the rotary axis I direction (main scanning direction Y) of the roller shaft 8*b*. An opening 72 of the hole 73 is a circular opening formed in the end surface 71 of the roller shaft 8*b*.

The first contact section 74 is shaped as a plane formed in the end surface 71 of the roller shaft 8*b* in the first direction D1 and a second direction D2, which are directions substantially orthogonal to the rotary axis I direction. The first contact section 74 is a ring-shaped plane whose inner circumferential circle is the opening 72 and outer circumferential circle is the peripheral circle of the end surface 71.

Next, the voltage applying unit 400 will be described in detail with reference to FIGS. 6 and 7.

As shown in FIG. 7, the voltage applying unit 400 includes the conductive terminal member 410, a terminal support member 411 that is conductive and supports the terminal member 410, the cover member 420 on which the terminal support member 411 is attached, a first screw member 414 that rotatably attaches the terminal support member 411 to the cover member 420, and a conductive wire 418 that is used for applying a voltage (the secondary transfer bias) to the terminal member 410.

As shown in FIGS. 6 and 7, the terminal member 410 includes a protrusion 415 that protrudes in such a manner that the protrusion 415 can be inserted into the hole 73 of the roller shaft 8*b* of the secondary transfer roller 8 and a base 417 having a second contact part (flange surface) 416 that contacts the first contact section 74 of the roller shaft 8*b* of the secondary transfer roller 8.

The base 417 is formed of a disk-shaped plate material. The base 417 faces the first contact section 74 of the roller shaft 8*b*.

The protrusion 415 protrudes from substantially the center of the second contact part 416 in the rotary axis I direction of the roller shaft 8*b* (main scanning direction Y). The protrusion 415 is formed of the columnar shape so that the peripheral edge of the protrusion 415 extends along the hole 73 of the roller shaft 8*b*. The axial direction of the protrusion 415 aligns with the rotary axis I direction of the roller shaft 8*b* (main scanning direction Y). The protrusion 415 has a diameter that at least allows the protrusion 415 to be inserted into the hole 73 of the roller shaft 8*b*. By inserting the protrusion 415 into the hole 73, the terminal member 410 engages the roller shaft 8*b*. When the terminal member 410 is engaged with the roller shaft 8*b*, the terminal member 410 does not interfere with the rotation of the roller shaft 8*b*.

The second contact part 416 is formed on the roller shaft 8*b* side surface of the base 417. The second contact part 416 is formed circumferentially around the protrusion 415 in a direction substantially orthogonal to the direction of the rotary axis I of the roller shaft 8*b*. The second contact part 416 is one of the surfaces of the base 417, the one on which the protrusion 415 is formed. In other words, the second contact part 416 is formed by one of the surfaces of the base 417 and is a ring-shaped plane contacting the first contact section 74 of the roller shaft 8*b*.

The second contact part 416 is disposed in contact with the first contact section 74 such that the surface direction of the second contact part 416 aligns with the surface direction of the first contact section 74. The second contact part 416 is electrically connected to the first contact section 74 by being in surface contact with the first contact section 74. The surface directions of the first contact section 74 and the second contact part 416 are substantially orthogonal to the rotary axis I direction of the roller shaft 8*b*. In this embodiment, the first contact section 74 and the second contact part 416 are in surface contact such that most of each other overlaps when the protrusion 415 of the terminal member 410 is inserted into the hole 73 of the roller shaft 8*b*.

As shown in FIGS. 6 and 7, the terminal support member 411 is formed of a plate member. The terminal support member 411 is disposed parallel to the third wall section 203*c* such that one of the surfaces of the terminal support member 411 faces the third wall section 203*c* side. The terminal support member 411 includes a first piece 422 that supports the terminal member 410, a second piece 423 that is connected to the first piece 422 and has a different-level surface with respect to the surface of the first piece 422, and a voltage-receiving part 412 that extends from the second piece 423 and receives a voltage application. As shown in FIG. 4, the first piece 422, the second piece 423, and the voltage-receiving part 412 form the terminal support member 411 as an integrated member.

The first piece 422 is formed of a substantially rectangular plate. The first piece 422 faces the first contact section 74 of the roller shaft 8*b*. The terminal member 410 is formed on the first piece 422. The surface of the base 417 on which the protrusion 415 is not formed is fixed to a surface of the first piece 422 on the roller shaft 8*b* side.

The second piece 423 is formed of a substantially rectangular plate. A first hole part 425 in which the first screw member 414 is inserted is formed in the center of the second piece 423. The second piece 423 is disposed adjacent to the first piece 422 and is connected to the first piece 422.

The second piece 423 is disposed parallel to the first piece 422 having a predetermined distance in the thickness direction of the second piece 423 such that the surface direction of the second piece 423 aligns with the surface direction of the first piece 422. The second piece 423 forms a different-level surface with respect to the first piece 422. The second piece 423 is disposed opposite to the third wall section 203*c* with respect to the first piece 422.

The first piece 422 and the second piece 423 are arranged such that one of the sides of the second piece 423 and one of the sides of the first piece 422 align in the surface directions. The first piece 422 and the second piece 423 are connected such that their levels differ along the aligned sides in the thickness direction.

In this embodiment, the first piece 422 and the second piece 423 forma substantially rectangular shapes as a whole when viewed from the direction in which their surface directions intersect orthogonally (main scanning direction Y). The terminal support member 411 is disposed such that the longitudinal directions of the first piece 422 and the second piece 423, which form the substantially rectangular shapes as a whole, extend along the longitudinal direction of the third wall section 203*c*. Here, the longitudinal direction of the third wall section 203*c* is a direction (second direction) D2 parallel to the surface of the third wall section 203*c* contacting the base 202 of the frame 201.

The terminal support member 411 is formed of a resilient plate member and urges the terminal member 410 toward the end surface 71 of the secondary transfer roller 8 (see FIG. 3). For example, a resilient force generated by the terminal support member 411 resiliently deforming toward the side opposite to the side of the end surface 71 of the roller shaft 8*b* causes the terminal member 410 to be urged toward the first contact section 74 such that the second contact part 416 of the terminal member 410 is pushed against the first contact section 74 of the roller shaft 8*b*.

The voltage-receiving part 412 is formed as a plate. The voltage-receiving part 412 extends from the second piece 423 from the side opposite to that to which the first piece 422 is connected, in the direction opposite to the first piece 422 and on the same plane as the second piece 423, and is connected to the second piece 423. The voltage-receiving part 412 is connected to the conductive wire 418 for applying a voltage (the secondary transfer bias).

The cover member 420 is formed of a long and thin member. The cover member 420 supports the terminal support member 411 to which the terminal member 410 is fixed in such a manner that the terminal support member 411 can rotate. The cover member 420 covers the entire terminal member 410 and part of the terminal support member 411 excluding the voltage-receiving part 412 from the side of the terminal member 410 on which the terminal support member 411 is not fixed.

The cover member 420 is fixed to the third wall section 203*c* such that the longitudinal direction of the cover member 420 is parallel to the longitudinal direction of the third wall section 203*c*. The cover member 420 has a cover depression 426 on the first wall section 203*a* side, formed by a depression from the third wall section 203*c* side. The cover depression 426 is formed at the end of the first wall section 203*a* side of the cover member 420 toward a direction away from the third wall section 203*c*.

The cover depression 426 includes an attaching surface 428 and a frame part 429. The attaching surface 428 is substantially rectangular and faces the third wall section 203*c*. The frame part 429 extends from the attaching surface 428 in a direction orthogonal to the direction of the third wall section 203*c* (main scanning direction Y) at the peripheral sections of the attaching surface 428 except for the first wall section 203*a* side of the attaching surface 428. Here, the frame part 429 is not formed at the edge of the first wall section 203*a* side of the attaching surface 428, and an opening in the second direction D2 is formed.

The terminal support member 411 to which the terminal member 410 is fixed is disposed in the cover depression 426. The terminal support member 411 is attached to the attaching surface 428 of the cover depression 426. The terminal support member 411 is disposed such that the voltage-receiving part 412 is positioned on the first wall section 203*a* side and the first piece 422 is positioned on the second wall section 203*b* side.

More specifically, the second piece 423 of the terminal support member 411 is disposed on the attaching surface 428 on the first wall section 203*a* side. The voltage-receiving part 412 of the terminal support member 411 extends outward from the opening of the cover depression 426 on the first wall section 203*a* side.

The terminal support member 411 is supported by the cover member 420 by means of rotatably attaching the second piece 423 to the attaching surface 428 of the cover depression 426. The terminal support member 411 is attached to the cover depression 426 with the first screw member 414 passed through the first hole part 425. In this way, the terminal support member 411 is capable of rotating around the first hole part 425 provided in the second piece 423.

Here, since the terminal support member 411 is formed in such a manner that the terminal support member 411 can rotate, the cover depression 426 is formed in such a manner that it does not interfere with the movement of the terminal support member 411 when the terminal support member 411 moves by following the movement of the secondary transfer roller 8. For example, the frame parts 429 provided at a predetermined distance apart from each other in the height direction (first direction) D1 of the third wall section 203*c* are disposed apart from each other in positions that do not interfere with the movement of the terminal support member 411.

The terminal member 410 fixed on the first piece 422 of the terminal support member 411 contacts the end surface 71 in the rotary axis I direction of the roller shaft 8*b* of the secondary transfer roller 8 when the terminal support member 411 is fixed to the cover member 420.

A second hole part 419 (hole part) through which a second screw 430 fixing the cover member 420 and the frame 201 is inserted is formed near the edge of the cover member 420 on the side opposite to the side on which the terminal support member 411 is disposed. The cover member 420 is fixed to the third wall section 203*c* with second screw 430 passed through the second hole part 419.

Next, the transfer-roller moving unit 250 will be described in detail with reference to FIGS. 2, 8, and 9.

As shown in FIG. 2, the transfer-roller moving unit 250 includes a shaft 270, a driving arm (transfer roller supporting part) 280, and a driving means (not shown) for driving the driving arm 280. The shaft 270 is a columnar member extending in a rotary axis J direction. The shaft 270 is disposed such that the rotary axis J direction of the shaft 270 is substantially parallel to the rotary axis I direction of the secondary transfer roller 8 (main scanning direction Y). In other words, the rotary axis I direction of the secondary transfer roller 8 aligns with the rotary axis J direction of the shaft 270. The shaft 270 is interposed between the secondary transfer roller 8 and the second wall section 203*b* in the frame 201.

The shaft 270 penetrates the third wall section 203*c* and the fourth wall section and is attached to the frame 201. The respective ends of the shaft 270 are attached to the third wall section 203*c* and the fourth wall section (not shown) in such a manner that the shaft 270 rotates around the rotary axis J.

The driving arm 280 is disposed along the third wall section 203*c* in the proximity of the third wall section 203*c* inside the frame 201. The driving arm 280 is shaped as an arm and is disposed substantially parallel to the third wall section 203*c*. The driving arm 280 is disposed substantially orthogonal to the rotary axis I direction of the secondary transfer roller 8 and the rotary axis J direction of the shaft 270. The roller shaft 8*b* of the secondary transfer roller 8 penetrates the edge section of the driving arm 280 on the first wall section 203*a* side. The edge section of the driving arm 280 on the first wall section 203*a* side rotatably supports the roller shaft 8*b*. The shaft 270 penetrates and is fixed to the edge section of the driving arm 280 of the second wall section 203*b* side. In this way, the driving arm 280 rotatably supports the secondary transfer roller 8 with respect to the frame 201.

More specifically, as shown in FIGS. 8 and 9, the roller shaft 8*b* of the secondary transfer roller 8 is rotatably attached to the edge section of the driving arm 280 on the first wall section 203*a* side. The shaft 270 is fixed to the edge section of the driving arm 280 on the third wall section 203*c* side in such a manner that the shaft 270 does not rotate with respect to the driving arm 280. In other words, the driving arm 280 fixed to the shaft 270 rotates around the rotary axis J in conjunction with the shaft 270 turning around the rotary axis J. The driving arm 280 turns around the rotary axis J of the shaft 270 in an arm contact direction J1 and an arm spacing direction J2. The arm contact direction J1 is the direction in which the secondary transfer roller 8 moves from the spacing position (see FIG. 8) where the transfer roller main body 8*a* of the secondary transfer roller 8 is apart from the intermediate transfer belt 7 to the contact position (see FIG. 9) where the transfer roller main body 8*a* of the secondary transfer roller 8 contacts the intermediate transfer belt 7 with the sheet T interposed therebetween. The arm spacing direction J2 is the direction in which the secondary transfer roller 8 moves from the contact position (see FIG. 9) where the transfer roller main body 8*a* of the secondary transfer roller 8 contacts the intermediate transfer belt 7 with the sheet T interposed therebetween to the spacing position (see FIG. 8) where the transfer roller main body 8*a* of the secondary transfer roller 8 is apart from the intermediate transfer belt 7.

In this way, the secondary transfer roller 8 attached to the driving arm 280 moves in the first contact direction D11 or the first spacing direction D12 by the movement of the roller shaft 8*b* of the secondary transfer roller 8 in conjunction with the rotating of the shaft 270 in the arm contact direction J1 or the arm spacing direction J2 around the rotary axis J of the shaft 270.

Strictly speaking, the movement of the roller shaft 8*b* is an arc motion. Here, however, the first contact direction D11 of the first direction D1, which is the moving direction of the roller shaft 8*b*, and the arm contact direction J1 of the rotating direction of the driving arm 280 are similar directions, and the first spacing direction D12 of the first direction D1, which is moving direction of the roller shaft 8*b*, and the arm spacing direction J2 of the rotating direction of the driving arm 280 are similar directions.

The counter roller 18 facing the secondary transfer roller 8 is disposed on the first contact direction D11 side of the secondary transfer roller 8 with the intermediate transfer belt 7 and the sheet T delivered through the first delivery path L1 interposed therebetween. The intermediate transfer belt 7 contacts the counter roller 18. The sheet T is delivered by being sandwiched between the transfer roller main body 8*a* of the secondary transfer roller 8 and the intermediate transfer belt 7. The transfer roller main body 8*a* of the secondary transfer roller 8 contacts or moves apart from the intermediate transfer belt 7 by the rotating of the driving arm 280. The transfer roller main body 8*a* of the secondary transfer roller 8 presses the sheet T against the intermediate transfer belt 7 by interposing the sheet T between the transfer roller main body 8*a* of the secondary transfer roller 8 and the counter roller 18.

As described above, the transfer-roller moving unit 250 moves the secondary transfer roller 8, as shown in FIGS. 8 and 9, to the spacing position where the transfer roller main body 8*a* of the secondary transfer roller 8 is away from the intermediate transfer belt 7 (see FIG. 8) and to the contact position where the transfer roller main body 8*a* of the secondary transfer roller 8 is in contact with the intermediate transfer belt 7 with the sheet T interposed therebetween (see FIG. 9). More specifically, when the sheet T is delivered through the first delivery path L1 to the secondary transfer nip N2, the secondary transfer roller 8 moves from the spacing position where the transfer roller main body 8*a* of the secondary transfer roller 8 is away from the intermediate transfer belt 7 (see FIG. 8) to the contact position where the transfer roller main body 8*a* of the secondary transfer roller 8 contacts the intermediate transfer belt 7 with the sheet T interposed therebetween (see FIG. 9) by the rotating of the driving arm 280 in the arm contact direction J1. When the secondary transfer roller 8 is in the contact position where the transfer roller main body 8*a* of the secondary transfer roller 8 contacts the intermediate transfer belt 7 with the sheet T interposed therebetween, the intermediate transfer belt 7 and the sheet T conveyed are interposed between the transfer roller main body 8*a* of the secondary transfer roller 8 and the counter roller 18 (see FIG. 9). The sheet T is pressed against the intermediate transfer belt 7 by the transfer roller main body 8*a* of the secondary transfer roller 8. Due to this and the effect of the secondary transfer bias applied to the secondary transfer roller 8, the toner image transferred by primary transfer to the intermediate transfer belt 7 is secondarily transferred to the sheet T. The sheet T on which the toner image is secondarily transferred is delivered from the secondary transfer nip N2 to the second delivery path L2 by the rotation of the secondary transfer roller 8 and the intermediate transfer belt 7. After the sheet T passes through the secondary transfer nip N2, the secondary transfer roller 8 moves from the contact position (see FIG. 9) to the spacing position (see FIG. 8) where the transfer roller main body 8*a* of the secondary transfer roller 8 is spaced apart from the intermediate transfer belt 7 by rotating of the driving arm 280 in the arm spacing direction J2.

As described above, the transfer roller main body 8*a* of the secondary transfer roller 8 contacts the intermediate transfer belt 7 with the sheet T interposed therebetween. But, in some cases, however, the transfer roller main body 8*a* of the secondary transfer roller 8 may directly contact the intermediate transfer belt 7. For example, when the transfer roller main body 8*a* of the secondary transfer roller 8 needs to contact the intermediate transfer belt 7 before the sheet T enters the secondary transfer nip N2, the transfer roller main body 8*a* of the secondary transfer roller 8 directly contacts the intermediate transfer belt 7 until the sheet T enters the secondary transfer nip N2. Moreover, when the transfer roller main body 8*a* of the secondary transfer roller 8 needs to be spaced apart from the intermediate transfer belt 7 after the rear edge of the sheet T is discharged from the secondary transfer nip N2, the transfer roller main body 8*a* of the secondary transfer roller 8 directly contacts the intermediate transfer belt 7 after the rear edge of the sheet T is discharged from the secondary transfer nip N2 until the transfer roller main body 8*a* of the secondary transfer roller 8 is spaced apart from the intermediate transfer belt 7. Furthermore, when images are continuously formed on the sheets T, the transfer roller main body 8*a* of the secondary transfer roller 8 directly contacts the intermediate transfer belt 7 between the sheets. In other words, The phrase "the transfer roller main body 8*a* of the secondary transfer roller 8 contacts the intermediate transfer belt 7 with the sheet T interposed therebetween" means that during image formation by the multi functional peripheral 1 there is a period in which the transfer roller main body 8*a* of the secondary transfer roller 8 contacts the intermediate transfer belt 7 with the sheet T interposed therebetween.

The driving means associated (as described above) with the transfer-roller moving unit 250 may, for example, be a structure that rotates the shaft 270 around the rotary axis J by a motor (not shown) or may be a structure that rotates the shaft 270 around the rotary axis J with lifting means for turning the edge section of the driving arm 280 on the secondary transfer roller 8 side in the arm contact direction J1 or the arm spacing direction J2.

Next, the operation of the terminal member 410 will be described with reference to FIGS. 8 to 11.

As shown in FIGS. 8 to 11, the terminal member 410 engages with the roller shaft 8*b* and is fixed to the terminal support member 411 rotatably supported on the cover member 420. Therefore, the terminal member 410 is rotatably supported with respect to the frame 201 and rotates to follow the movement of the secondary transfer roller 8 in conjunction with the movement of the secondary transfer roller 8 by the transfer-roller moving unit 250. More specifically, the secondary transfer roller 8 moves in the first contact direction D11 or the first spacing direction D12 by the rotating of the driving arm 280. In such a case, since the terminal member 410 is engaged with the roller shaft 8*b* of the secondary transfer roller 8 by inserting the protrusion 415 of the terminal member 410 into the hole 73 of the end surface 71 of the secondary transfer roller 8, the terminal member 410 moves to follow the movement of the secondary transfer roller 8.

With this embodiment, when the transfer-roller moving unit 250 moves the secondary transfer roller 8 from the spacing position (see FIGS. 8 and 10) to the contact position (see FIGS. 9 and 11), the terminal member 410 moves to follow the movement of the secondary transfer roller 8 (moves in the first contact direction D11 in FIGS. 8 and 10). More specifically, the terminal support member 411 on which the terminal member 410 is fixed rotates in such a manner that the terminal member 410 moves in the first contact direction D11 around the first hole part 425 by the movement of the secondary transfer roller 8. When the secondary transfer roller 8 moves to the contact position where the transfer roller main body 8*a* of the secondary transfer roller 8 contacts the intermediate transfer belt 7 with the sheet T interposed therebetween, the first piece 422 and second piece 423 of the terminal support member 411 are positioned substantially parallel to the base 202 of the frame 201 (see FIGS. 9 and 11).

Also, when the transfer-roller moving unit 250 moves the secondary transfer roller 8 from the contact position (see FIGS. 9 and 11) to the spacing position (see FIGS . 8 and 10), the terminal member 410 moves so as to follow the movement of the secondary transfer roller 8 (moves in the first spacing direction D12 in FIGS. 9 and 11). More specifically, the terminal support member 411 on which the terminal member 410 is fixed rotates in such a manner that the terminal member 410 moves in the first spacing direction D12 around the first hole part 425 by the movement of the secondary transfer roller 8. When the secondary transfer roller 8 moves to the spacing position where the transfer roller main body 8*a* of the secondary transfer roller 8 is spaced away from the intermediate transfer belt 7, the terminal support member 411 supporting the terminal member 410 is positioned such that terminal member 410 side of the terminal support member 411 tilts toward the base 202 side of the frame 201 (see FIGS. 8 and 10).

Next, the contact state of the first contact section 74 of the roller shaft 8*b* and the second contact part 416 of the terminal member 410 will be described in detail with reference to FIGS. 8 to 11.

As shown in FIGS. 8 and 10, in case the secondary transfer roller 8 is in the spacing position with respect to the intermediate transfer belt 7, the first contact section 74 of the roller shaft 8*b* of the secondary transfer roller 8 is in surface-contact with the second contact part 416 of the terminal member 410 in the state where the protrusion 415 of the terminal member 410 is relatively rotatably inserted into the hole 73 of the end surface 71 of the secondary transfer roller 8. With this embodiment, when the protrusion 415 is inserted into the hole 73, the first contact section 74 contacts the second contact part 416 in a stable surface contact state. Thus, contact state of the first contact section 74 and the second contact part 416 is excellent.

The terminal support member 411 supporting the terminal member 410 urges the terminal member 410 toward the end surface 71 of the secondary transfer roller 8. Even when the secondary transfer roller 8 moves in the rotary axis I direction, the terminal member 410 is urged toward the end surface 71 so as to follow the movement of the secondary transfer roller 8 in the rotary axis I direction. Thus, the contact state of the first contact section 74 and the second contact part 416 can be easily maintained.

According to this embodiment, the transfer-roller moving unit 250 causes the secondary transfer roller 8 to be moved from the spacing position (see FIGS. 8 and 10) to the contact position (see FIGS. 9 and 11) or from the contact position (see FIGS. 9 and 11) to the spacing position (see FIGS. 8 and 10). In these cases, the secondary transfer roller 8 moves in the first contact direction D11 or the first spacing direction D12 by the transfer-roller moving unit 250.

Here, the first contact section 74 and the second contact part 416 are in surface contact since the roller shaft 8*b* and the terminal member 410, which are adjacently disposed in the rotary axis I direction of the secondary transfer roller 8 (main scanning direction Y), are in contact (see FIG. 3). The secondary transfer roller 8 moves in the first contact direction D11 or the first spacing direction D12, which are directions orthogonal to the rotary axis I direction (main scanning direction Y) (see FIGS. 8 and 9). Therefore, the contact state of the first contact section 74 and the second contact part 416 is less likely to be affected by the movement of the secondary transfer roller 8 in the first contact direction D11 or the first spacing direction D12.

This is because the terminal member 410 is urged toward the end surface 71 of the secondary transfer roller 8. In other words, this is because the urging direction of the terminal member 410 is the rotary axis I direction (main scanning direction Y). Therefore, the contact state of the first contact section 74 and the second contact part 416 is less affected by the movement of the secondary transfer roller 8 and is stable.

According to the image forming apparatus of this embodiment, the following advantages are achieved.

According to this embodiment, the image forming apparatus includes the secondary transfer roller 8 having the roller shaft 8*b* and the transfer roller main body 8*a* fixed on the roller shaft 8*b* and capable of contacting the sheet T at is circumferential surface. The transfer-roller moving unit 250 rotatably supports the secondary transfer roller 8 with respect to the frame 201 and moves the transfer roller main body 8*a* to the contact position where the transfer roller main body 8*a* contact the intermediate transfer belt 7 and the spacing position where the transfer roller main body 8*a* is spaced apart from the intermediate transfer belt 7. The terminal member 410 contacts the end surface 71 of the roller shaft 8*b* to supply a voltage. Finally, the terminal support member 411 rotatably supports the terminal member 410 with respect to the frame 201, wherein the terminal member 410 maintains a contact state with the end surface 71 of the roller shaft 8*b* while rotating to follow the movement of the secondary transfer roller 8. Thus, at the contact position of the secondary transfer roller 8, the terminal member 410 can stably maintain an excellent contact state of the end surface 71 of the secondary transfer roller 8 and the terminal member 410. Furthermore, the terminal member 410 can stably supply a voltage to the secondary transfer roller 8. Thus, the multi functional peripheral 1 can stably form images.

With this embodiment, the roller shaft 8*b* has the hole 73 formed in the end surface 71 thereof, and the terminal member 410 has the protrusion 415 protruding in such a manner that the protrusion 415 is inserted into the hole 73. In the state where the protrusion 415 is relatively rotatably inserted into the hole 73 with respect to the hole 73, the end surface 71 and the terminal member 410 are electrically connected while the end surface 71 contacts the terminal member 410. Thus, the terminal member 410 moves so as to follow the movement of the secondary transfer roller 8 since the protrusion 415 of the terminal member 410 is inserted into the hole 73 of the end surface 71 of the secondary transfer roller 8. Furthermore, by contacting the end surface 71 and the terminal member 410, when the secondary transfer roller 8 is in the contact position, the terminal member 410 can stably support the contact state of the end surface 71 of the secondary transfer roller 8 and the terminal member 410. Thus, the multi functional peripheral 1 can stably form images.

With this embodiment, the roller shaft 8*b* has the first contact section 74 disposed outward of the hole 73 of the end surface 71; the terminal member 410 has the second contact part 416 disposed outward of the protrusion 415; and in a contact state, the first contact section 74 and the second contact part 416 contact each other by surface contact. Therefore, the contact state of the first contact section 74 and the second contact part 416 can be stably maintained. Thus, the image quality of the images formed by the multi functional peripheral 1 are stable.

With this embodiment, the terminal support member 411 is formed of a resilient plate member and urges the terminal member 410 toward the end surface 71 of the roller shaft 8*b*. Therefore, the contact state of the first contact section 74 and the second contact part 416 becomes even more stable. Thus, the image quality of the images formed by the multi functional peripheral 1 are stable.

The preferred embodiments of the present invention have been described above. The present invention however is not limited thereto and may be realized in various forms.

For example, the transfer-roller moving unit 250 according to the above-described embodiment includes the shaft 270, the driving arm 280, and the driving means (not shown in the drawings) for driving the driving arm 280. The configuration of the transfer-roller moving unit 250, however, is not limited thereto.

With the above-described embodiment, the transfer roller according to the present invention is applied to the secondary transfer roller 8. The transfer roller, however, is not limited thereto. For example, the transfer roller of the present invention may be a primary transfer roller or a direct transfer roller of an image forming apparatus employing a direct transfer method.

Furthermore, the present invention is not limited to the embodiment described above and may be realized in various forms. For example, in the embodiment, the multi functional peripheral 1 is described as an image forming apparatus. This multi functional peripheral may be a color multi functional peripheral or a monochrome multi functional peripheral. The image forming apparatus is not limited thereto and may include a copy machine which only includes copy function, a printer, a facsimile, or a combination thereof.

What is claimed is:

1. An image forming apparatus comprising:

a chassis;

an image carrier on whose surface a toner image is formed;

a transfer roller configured to transfer the toner image formed on the image carrier onto a recording medium, the transfer roller including, a roller shaft, and a transfer roller main body fixed on the roller shaft and configured to contact the recording medium on a circumferential surface thereof;

a frame disposed inside the chassis;

a transfer-roller supporting part configured to support the transfer roller in such a manner that the transfer roller freely turns with respect to the frame and to move the transfer roller to a contact position where the transfer roller main body contacts the image carrier and a spacing position where the transfer roller main body is spaced apart from the image carrier;

a terminal member configured to contact an end surface of the roller shaft and supply a voltage to the transfer roller; and a terminal supporting member configured to rotatably support the terminal member with respect to the frame, wherein the terminal member rotates while following the movement of the transfer roller between the contact position and the spacing position, wherein the terminal member maintains a contact state with the end surface of the roller shaft, and wherein the roller shaft has a hole formed in the end surface thereof, the terminal member has a protrusion protruding in such a manner that the protrusion can be inserted into the hole, and the end surface and the terminal member contact each other and are electrically connected when the protrusion is relatively rotatably inserted into the hole.

2. The image forming apparatus according to claim 1, wherein:

the end surface of the roller shaft has a contact surface surrounding the hole, the terminal member has a flange surface formed circumferentially around the protrusion, and the contact state of the contact surface and the flange surface is surface contact.

3. The image forming apparatus according to claim 1, wherein the terminal supporting member comprises a resilient plate member and urges the terminal member toward the end surface of the roller shaft.

4. The image forming apparatus according to claim 1, wherein:

the terminal supporting member has a hole part for supporting the terminal supporting member, and the terminal supporting member rotates around the hole part.

5. The image forming apparatus according to claim 1, wherein a depression is formed in the frame at an area where one of the ends of the roller shaft of the transfer roller is positioned so that the movement of the transfer roller is not interfered with by the frame.

6. The image forming apparatus according to claim 1, wherein a shaft for turning the transfer-roller supporting part is fixed to one end of the transfer-roller supporting part, and the transfer roller is rotatably supported at the other end of the transfer-roller supporting part.

7. A transfer roller bias system for an image forming apparatus, comprising:

a chassis;

an image carrier on whose surface a toner image is formed;

a transfer roller configured to transfer a toner image from a surface of an image carrier onto a recording medium, the transfer roller including, a roller shaft, and a transfer roller main body fixed on the roller shaft and configured to contact the recording medium on a circumferential surface thereof;

a frame disposed inside the chassis;

a transfer-roller supporting part configured to support the transfer roller in such a manner that the transfer roller freely turns with respect to the frame and to move the transfer roller to a contact position where the transfer roller main body contacts the image carrier and a spacing position where the transfer roller main body is spaced apart from the image carrier;

a terminal member configured to contact an end surface of the roller shaft and supply a voltage to the transfer roller; and a terminal supporting member configured to rotatably support the terminal member with respect to the frame, wherein the terminal member rotates while following the movement of the transfer roller between the contact position and the spacing position, wherein the terminal member maintains a contact state with the end surface of the roller shaft, and wherein the roller shaft has a hole formed in the end surface thereof, the terminal member has a protrusion protruding in such a manner that the protrusion can be inserted into the hole, and the end surface and the terminal member contact each other and are electrically connected when the protrusion is relatively rotatably inserted into the hole.

8. The transfer roller bias system according to claim 7 wherein:

the end surface of the roller shaft has a contact surface surrounding the hole, the terminal member has a flange surface formed circumferentially around the protrusion, and the contact state of the contact surface and the flange surface is surface contact.

9. The transfer roller bias system according to claim 7, wherein the terminal supporting member comprises a resilient plate member and urges the terminal member toward the end surface of the roller shaft.

10. The transfer roller bias system according to claim 7, wherein:

the terminal supporting member has a hole part for supporting the terminal supporting member, and the terminal supporting member rotates around the hole part.

11. The transfer roller bias system according to claim 7, wherein a depression is formed in the frame at an area where one of the ends of the roller shaft of the transfer roller is positioned so that the movement of the transfer roller is not interfered with by the frame.

12. The transfer roller bias system according to claim 7, wherein a shaft for turning the transfer-roller supporting part is fixed to one end of the transfer-roller supporting part, and the transfer roller is rotatably supported at the other end of the transfer-roller supporting part.

* * * * *